United States Patent [19]

Sears

[11] Patent Number: 4,993,703

[45] Date of Patent: Feb. 19, 1991

[54] CONVERTIBLE ROCKING TOY

[75] Inventor: Michael Sears, Millington, Mich.

[73] Assignees: William H. Sears; David G. Sears, both of Burton, Mich.

[21] Appl. No.: 402,230

[22] Filed: Sep. 5, 1989

[51] Int. Cl.[5] ..... A63G 17/00

[52] U.S. Cl. ..... 272/52; 297/272

[58] Field of Search ..... 272/52, 52.5, 53.1, 272/53.2; 297/258, 270, 271, 272, 283; 280/1.16, 1.188, 1.193

[56] References Cited

U.S. PATENT DOCUMENTS

| | | | |
|---|---|---|---|
| 419,405 | 1/1890 | Bessette | 272/52.5 |
| 1,846,393 | 2/1932 | Hankins | 272/52 |
| 2,372,384 | 3/1945 | Lutz | 272/52 |
| 2,658,753 | 11/1953 | Dawson | 272/52 X |
| 3,075,263 | 1/1963 | May | 272/52.5 |
| 4,129,296 | 12/1978 | Meyer | 272/52 |

*Primary Examiner*—Richard E. Chilcot, Jr.
*Attorney, Agent, or Firm*—John R. Benefiel

[57] ABSTRACT

A rocker toy convertible from a riding rocker to a cradle use by orienting a intermediate platform in either of two rotative positions on a rocker assembly, disposed lengthwise or transversely to the rocking direction. A removable saddle-closure is attached to a miniature chest separately usable as a play item. The platform securely locks to a crosspiece included in the rocker assembly in either rotative position.

11 Claims, 2 Drawing Sheets

CONVERTIBLE ROCKING TOY

This invention concerns riding figure toys commonly referred to as rocking horses, in which the figure of a horse (or other animal) is supported on rockers and adapted to be mounted by a child so as to be ridden. Such a toy is typically a childhood favorite of young children for most of their early years.

The ability to use a rocking horse over several periods during a child's development from infancy would increase its appeal. Such extended period of use could be realized if the rocking horse could be convertible from a cradle, as it could be employed initially for the child as an infant, as a rocking horse as the child grows older, and later by the child as a cradle for dolls. This extended period of use would justify the expense of a quality constructed rocking horse.

In U.S. Pat. No. 267,678 there is disclosed a rocking horse convertible from a cradle configuration, but the arrangement shown therein describes rocking of the infant in a lengthwise direction contrary to the usual sideways cradle rocking motion.

Also, since vigorous riding activity must be anticipated, the construction of a rocking horse must be sturdy and well designed to mimimize injuries.

SUMMARY OF THE INVENTION

The present invention comprises a riding horse or other riding figure toy which is readily convertible between riding and cradle configurations. A riding figure is attached to an intermediate pivot platform which in turn is mounted to a rocker assembly so as to be oriented in either of two rotated positions. In a first position the riding figure is disposed lengthwise parallel to the rockers, for conventional use with a child astride a saddle portion of the figure.

In a second rotated position the figure is disposed transversely to the rockers. A saddle portion is removable from the figure to create a cradle cavity, which is thereby disposed transversely to the rockers, enabling side-to-side conventional cradle rocking action. This enables use of the rocking toy both in the infancy of a child as a cradle and later as a cradle for the child's play use with dolls.

This removable saddle portion preferably takes the form of a compartmented miniature play chest, itself separately usable and when in position affords a fail safe preventive against covering the cradle cavity with an infant within.

The intermediate pivot platform is generally in rectangular form with angled corners, which wedge beneath complementarily shaped locking features formed on the rocker assembly in each rotated position, securely retaining the platform and figure on the rockers in each position. A locking pin is insertable to fix the platform and figure in either rotative position.

A cut out in either side of the platform provides a step to facilitate mounting of the figure when used as a riding toy.

DETAILED DESCRIPTION.

In the following detailed description, certain specific terminology will be employed for the sake of clarity and a particular embodiment described, but it is to be understood that the same is not intended to be limiting and should not be so construed inasmuch as the invention is capable of taking many forms and variations within the scope of the appended claims.

Figure 1:
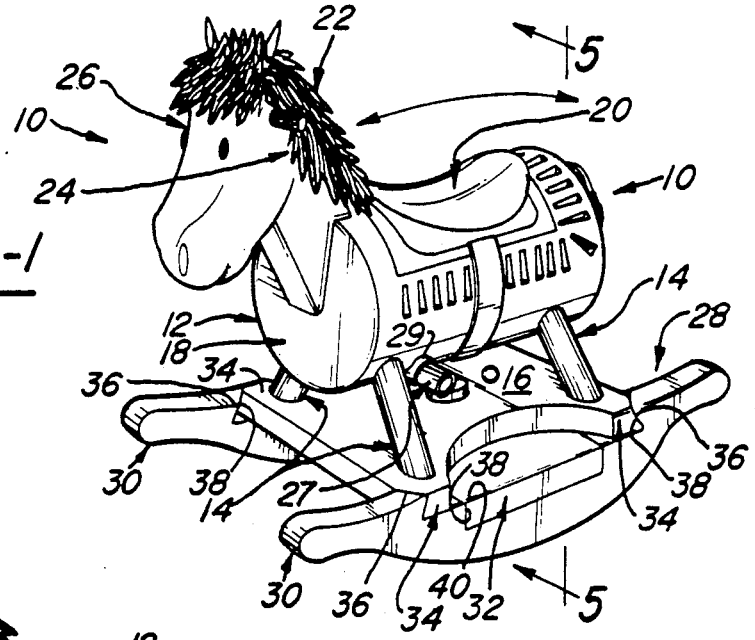
FIG. 1 is a perspective view of a convertible rocking toy according to the present invention, shown in the riding configuration.

Referring to FIG. 1, the rocking toy 10 according to the present invention includes a horse riding FIG. 12 supported on outwardly inclined legs 14 above an intermediate platform 16.

The horse riding FIG. 12, could of course represent other animals or objects, and has an elongated body portion 18, here provided by a barrel shaped structure. This body portion 18 provides a ridable support for a child seated astride a saddle surface 20. The child may grasp the mane 22 or suitable handles 24 extending from the head 26 attached to the body 18 in conventional fashion. Retractable foot rests 27 may also be provided, slidably received in sockets extending from the body 18.

The platform 16 is supported on a rocker assembly 28, the assembly including a pair of laterally spaced rockers 30 connected by a crosspiece 32 fixed to each rocker 30.

The intermediate platform 16 is generally square in shape and each corner 34 is shaped with an angled surface 36 which wedges beneath a complementary mating surface 38 formed at the ends of recesses 40 let into the top of each rocker 30. This draws the platform 16 and attached riding FIG. 12 tightly to the rocker assembly 28 to prevent any looseness of the platform 16 and FIG. 22 on the rocker assembly 28 and prevents dislodgement thereof.

A cutout 42 in either side of the platform creates a step up for easier mounting of the riding FIG. 12, when configured as a rocking horse and affords a toe clearance when in the cradle configuration.

The riding FIG. 12, in the orientation shown in FIG. 1, extends parallel to the rockers 30 for conventional rocking horse action.

Figure 2:
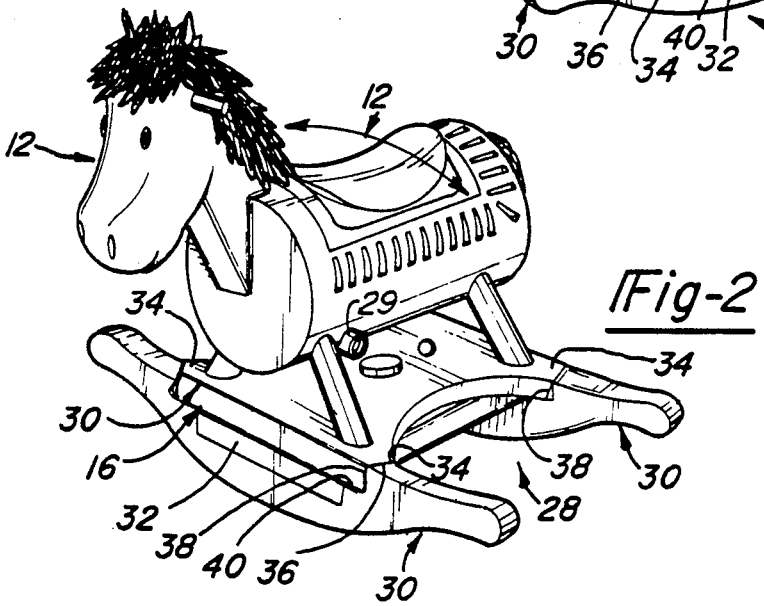
FIG. 2 is a perspective view of the rocking toy shown in FIG. 1 in le orientation of the platform and figure.

FIG. 2 shows the riding FIG. 12 and platform 16 rotated on the rocker assembly 28 to extend transversely to the rockers 30 preparatory to conversion to a cradle. In this orientation, the corners 34 of the platform 16 likewise wedge beneath the surfaces 38 and the rocker recess 40. The handles 27 may be retracted into the sockets 29, to be out of the way as shown.

Figure 3:
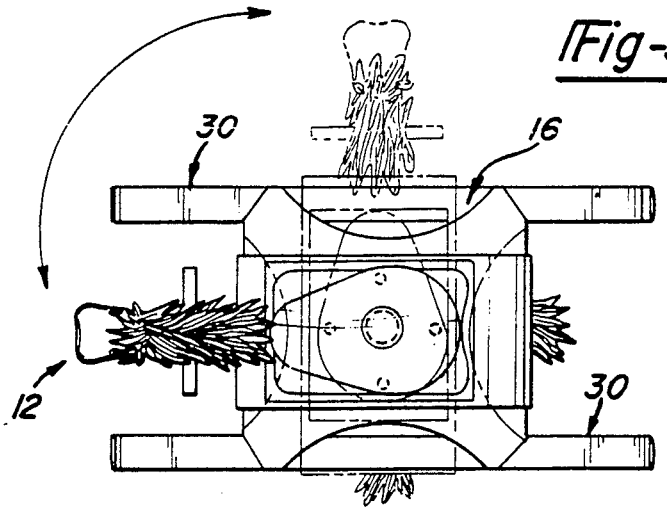
FIG. 3 is a plan view of the rocking toy shown in FIG. 1 with the configuration shown in phantom.

This rotation of the riding FIG. 12 is shown in FIG. 3.

Figure 4:
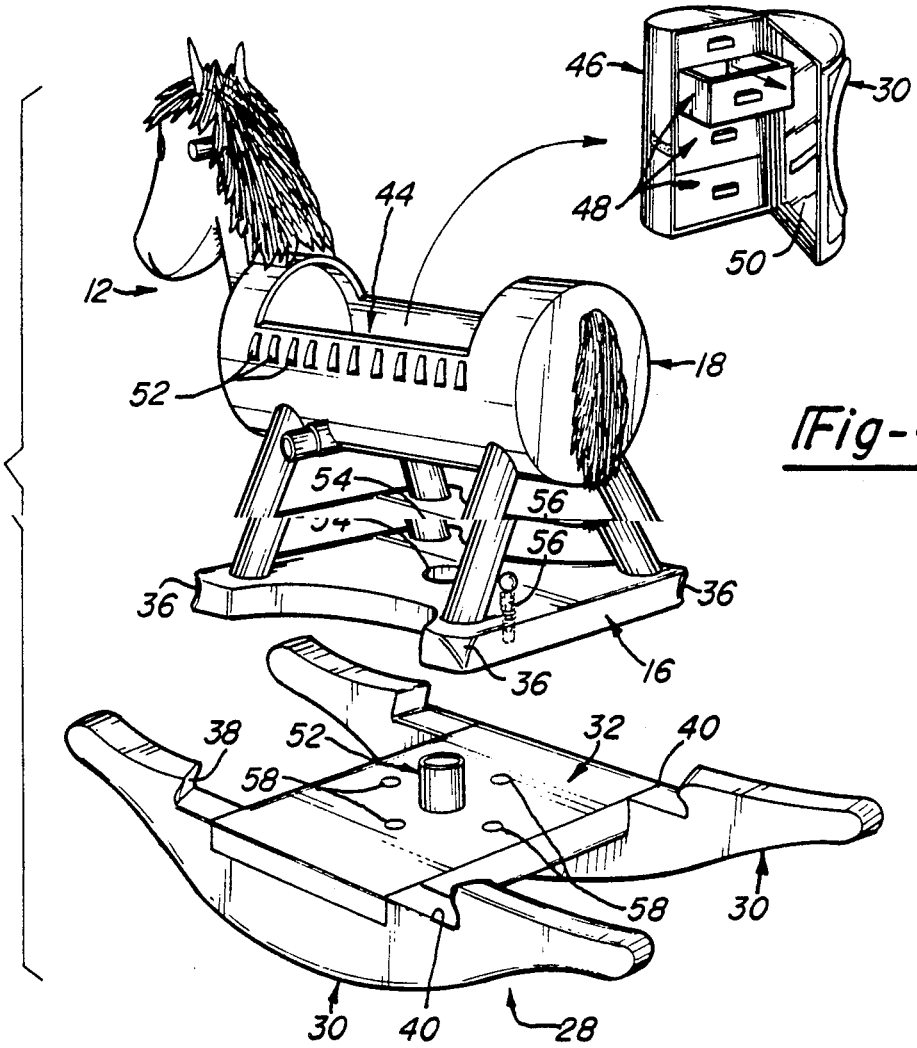
FIG. 4 is an exploded perspective view of the rocking toy shown in FIGS. 1–3 illustrating the major components thereof.

The saddle 30 may be removed as shown in FIG. 4 to enable access to a cradle cavity 44 formed extending along and within the elongated body portion 18 of the riding FIG. 12. As also seen in FIG. 4, the saddle 30 is preferably formed as the top of a structure 46 which fills the cradle cavity 44, so as to prevent the cavity 44 from being occupied when the saddle 30 is in place. The structure 46 may advantageously take the form of a miniature compartmented storage chest having drawers 48 and a mirror 50, usable as a separate play item.

Vent openings 52 may also be provided extending into the cradle cavity 44 adding an additional safety feature in the event a small child or infant is placed in the cavity 44 and the saddle area covered.

The riding FIG. 12 and attached platform 16 are pivotably mounted onto the rocker assembly 28 by a pivot tube 52 extending upwardly from the crosspiece 32. The pivot tube 52 is received in a bore 54 formed in the platform 16 to enable rotation of the platform on the rocker assembly 28 about a fixed axis.

Figure 5:
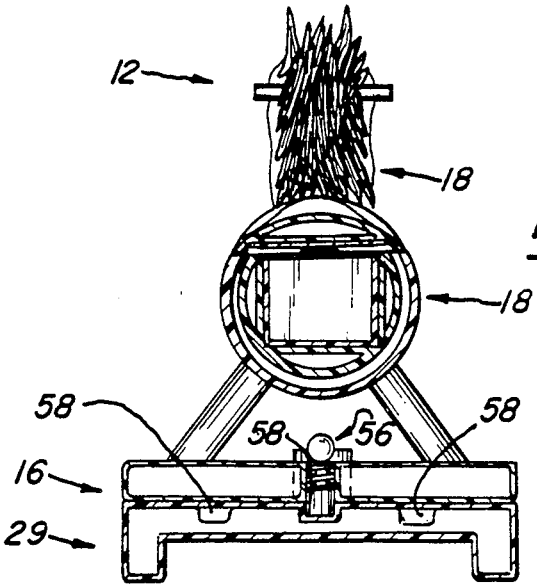
FIGURE 5 is a transverse sectional view of the rocking toy shown in FIGS. 1–4 illustrating details of the pivot and locking pin associated with the intermediate platform.

A locking pin 56 is received in the platform 16 which can be inserted in mating holes 58 located to fix the platform 16 in either transverse or longitudinal orientation with respect to the rocker assembly 28, as seen in FIG. 5.

The various components may be constructed of molded plastic as shown in FIG. 5, or solid plastic or wooden parts, are other alternate construction as desired.

Similarly, the pivoting action may be provided by various alternate mechanical arrangements.

Accordingly, the riding toy as described may be used as a cradle by a simple convertible action, and is of interest to small children of all ages, so that it is useful over an extended period of a child's life.

The construction is simple and rugged, and its design offers security against injury caused by the mishaps to be expected.

I claim:

1. A convertible riding figure cradle toy comprised of:

a riding figure having an elongated body portion adapted to receive a figure astride said body portion;

an intermediate platform having said riding figure fixed above the upper surface thereof;

a rocker assembly having parallel curved rockers enabling a lengthwise rocking action;

convertible mounting means adjustably mounting said platform and riding figure atop said rocking assembly in either of two orientations, a first orientation with said body portion extending parallel to said rockers for conventional riding rocking movement thereof, and a second orientation with said body portion extending transversely thereto;

said body portion being formed with a cradle cavity extending transversely to said rockers with said platform in said second orientation;

saddle closure means removably covering said cradle cavity whereby enabling use of said toy as a riding figure or cradle.

2. The convertible riding figure cradle according to claim 1 wherein said rocker assembly includes a cross piece, and said convertible mounting means includes means pivotally mounting said platform atop said crosspiece.

3. The convertible riding figure cradle according to claim 2 further including locking means selectively locking said platform in either said first or second rotated position.

4. The convertible riding figure cradle according to claim 1 wherein said platform is formed with locking surfaces at the periphery thereof wedging with mating surfaces on said rocker assembly securing said platform and rocker assembly together in each orientation of said platform thereon.

5. The convertible riding figure cradle according to claim 1 wherein said saddle-closure means comprises a structure occupying said cradle cavity when in place.

6. The convertible riding figure cradle according to claim 5 wherein said structure comprises a miniature chest of drawers.

7. The convertible riding figure cradle according to claim 4 wherein said platform comprises a generally rectangular piece having said locking surface at the corners thereof.

8. The convertible riding figure cradle according to claim 1 wherein said figure comprises a horse figure having a head extending above one end of said body portion.

9. The convertible riding figure cradle according to claim 3 wherein said lock means includes a pin carried by said platform and selectively insertable into holes in said cross piece.

10. The convertible riding figure cradle according to claim 1 wherein said body portion is formed with vent holes extending into said cradle cavity.

11. The convertible riding figure cradle according to claim 1 further including handles at the forward end of said figure retractably mounted therein.

* * * * *